US005431276A

United States Patent [19]

Lialin

[11] Patent Number: 5,431,276

[45] Date of Patent: Jul. 11, 1995

[54] MULTIFUNCTIONAL LID

[75] Inventor: Tony Lialin, South San Franscisco, Calif.

[73] Assignee: Quik-Lid, Inc., Soquel, Calif.

[21] Appl. No.: 115,324

[22] Filed: Sep. 2, 1993

[51] Int. Cl.[6] ..... B65D 81/32

[52] U.S. Cl. ..... 206/222; 206/217; 206/219; 426/112

[58] Field of Search ..... 206/217, 219–222, 206/568; 215/227; 220/521; 222/80; 426/112, 120

[56] References Cited

U.S. PATENT DOCUMENTS

| | | | |
|---|---|---|---|
| 3,326,363 | 6/1967 | Bennett et al. | 206/219 |
| 3,743,520 | 7/1973 | Croner | 206/219 |
| 3,796,813 | 3/1974 | Kurland | 206/217 |
| 4,785,931 | 11/1988 | Weir et al. | 206/222 |
| 5,035,320 | 7/1991 | Plone | 206/222 |
| 5,052,553 | 10/1991 | De Sanctis | 206/219 |

*Primary Examiner*—Jimmy G. Foster
*Attorney, Agent, or Firm*—Warren & Perez

[57] ABSTRACT

The invention is an attachable lid for dispensing additives into a cup. The lid has a plurality of compartments which contain additives. Each compartment has a plunger such that when pressure is applied to the lid the plunger punctures the bottom of the compartment and the additive is dispensed into the cup.

14 Claims, 2 Drawing Sheets

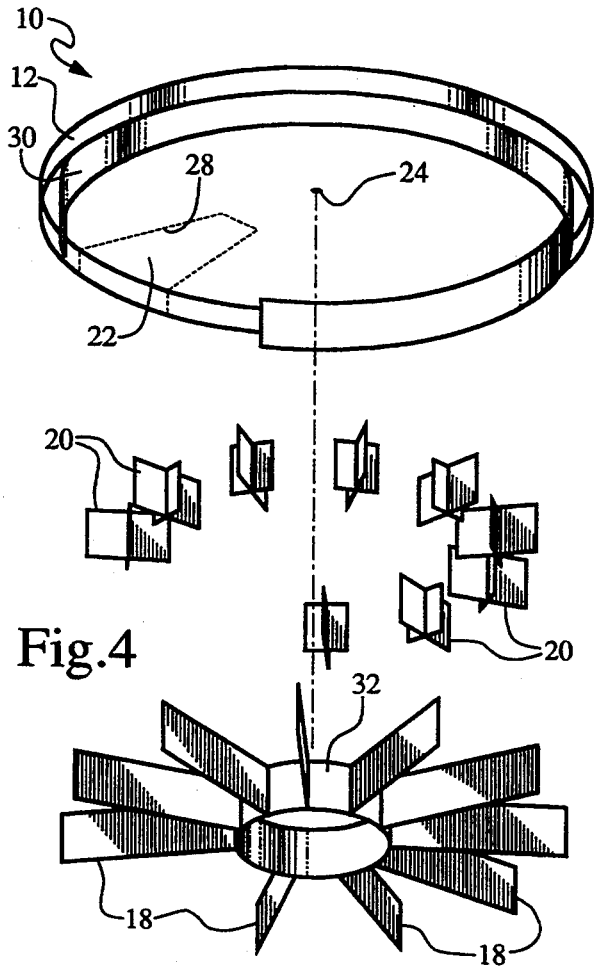
Fig.4
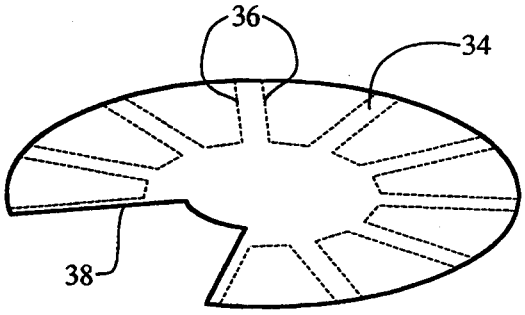
Fig.5
Fig.6
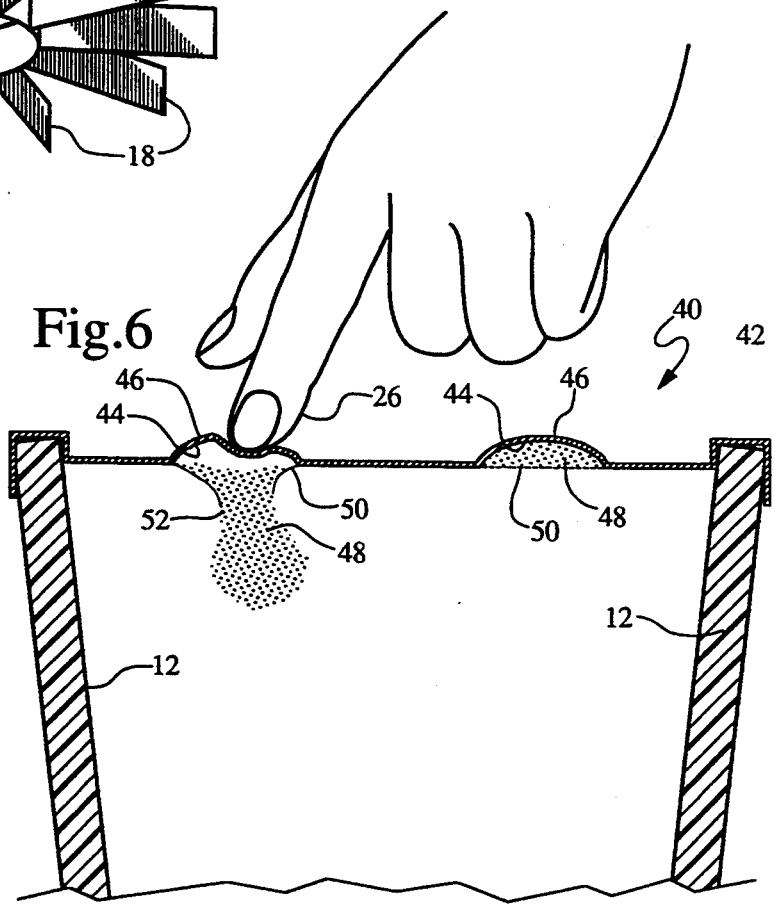

MULTIFUNCTIONAL LID

TECHNICAL FIELD OF THE INVENTION

The present invention relates to a lid for a container. More particularly, the invention relates to an attachable lid containing compartments for dispensing of additives into a cup.

BACKGROUND OF THE INVENTION

The fast-food industry increasingly demands for a more efficient and expedious method of serving its clientele in a cost effective manner. When serving beverages, customarily lids are placed on cups to maintain the beverage at its desired temperature. At the same time, condiments, such as sugar and cream are supplied to the customer for use in flavoring the beverage. While this method of supplying the goods to the consumer works, it is generally cumbersome and wastelid to have the condiments separate from the lid since the consumer is required to open the lid, insert the desired condiment into the cup and dispose of the condiments wrapper.

The present invention discloses an apparatus which combines the lid and condiments in such a manner as to encourage cost savings, while at the same time be enviromnentally friendly by reducing waste.

The goal of reducing waste has led to a search for such an environmentally sound product, as is the present invention. The present invention is not only a quick and easy method for dispensing additives into a cup, but also eliminates the need for individually packaged items like sugar and creamer. In addition, the present invention discloses a lid having condiments or additives contained within the lid to save storage space.

SUMMARY OF THE INVENTION

The present invention discloses a device for permitting a user to dispense creamer, sugar, artificial sweetener or other additives into a cup of coffee or tea. In essence, the present invention discloses the combination of a plurality of compartments having the additive contained therein.

The device generally comprises a lid having a lip for securing the lid to a cup. The lid has perforations for allowing the drinker to create an opening through which to drink. Attached perpendicularly to the bottom of the lid is a set of inner and outer rims. A plurality of juxtaposed dividers connect the outer rim to the inner rim. Such a connection of dividers to the rims creates the plurality of compartments for holding the additives.

Each compartment contains a plungers extending from the bottom of the lid. A bottom cover having perforations that correspond to the compartments seals the additives. In operation, the user ruptures the bottom cover with the plunger when pressure is applied to lid, thereby dispensing the additive into the cup.

DESCRIPTION OF THE DRAWINGS

The invention can be more readily understood by reference to the Drawings set forth below.

FIG. 4 is an exploded view of the lid;

FIG. 5 is a perspective view of the bottom cover; and

FIG. 6 is a cross-sectional view of an alternative embodiment of the present invention.

DETAILED DESCRIPTION OF THE INVENTION

Figure 1:
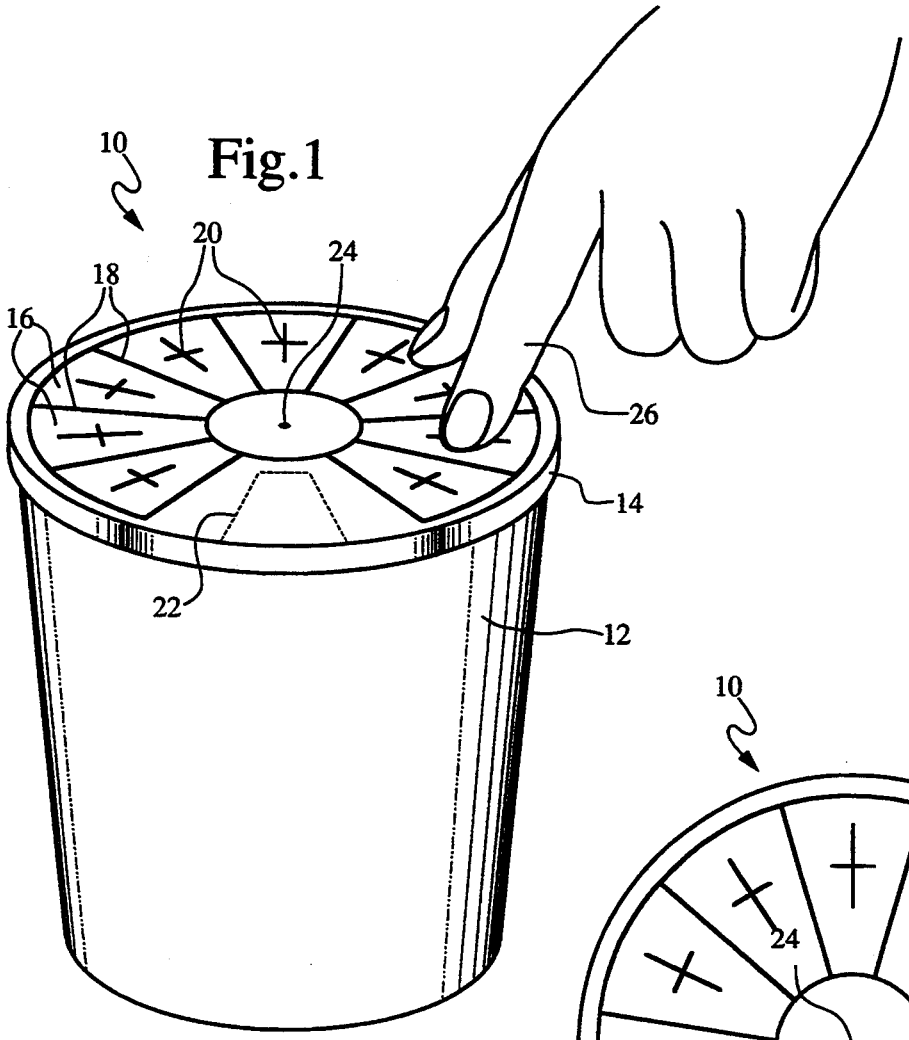
FIG. 1 is a perspective view of a lid connected to a cup as seen in its environment.

The present invention is a multifunctional lid for a cup for permitting a user to actuate the lid such that an additive is dispensed into the cup which is generally designated 10 in FIG. 1. As can be seen, a lid 10 is connected to a cup 12 by a lip 14 which is integrally connected to lid 10. As will be more fully appreciated after subsequent disclosure, lid 10 has a plurality of compartments aligned along its periphery which are created by having a plurality of dividers 18 separated in equi-distances along lid 10. Contained within compartments 16 are a plurality of plungers 20. Plungers 20 are used to actuate the flow of additive from compartment 16 into cup 12.

Also contained on lid 10 is a lid opening 22. In addition, lid 10 has a steam hole 24 formed therein for permitting vapor to escape from cup 12. In operation, a user 26 asserts pressure upon lid 16 to force plunger 20 of its compartments 16 to dispense an additive (not shown) into cup 12. As can be appreciated by one skilled in the art, lid 10 can have a stir stick (not shown) moveably attached thereto for allowing the user to mix the fluid contained in cup 12.

Figure 2:
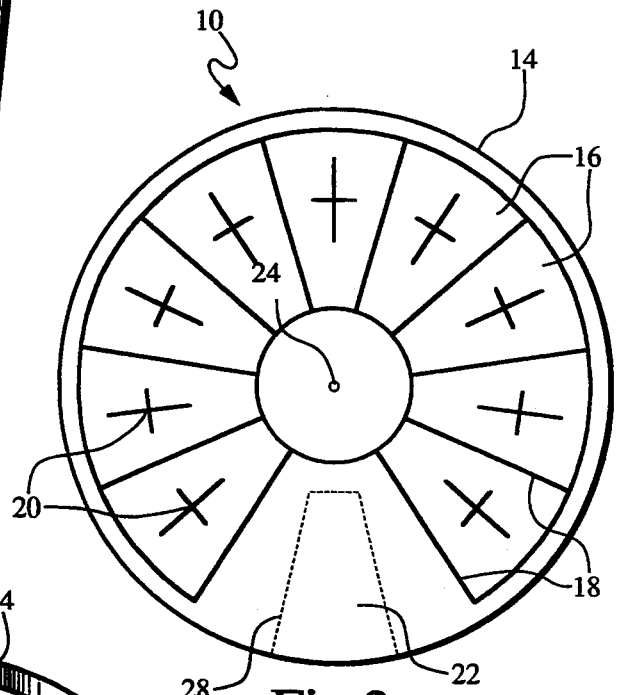
FIG. 2 is a top view of the lid.

Referring now to FIG. 2, the present invention 10 can be seen in a top view perspective. Generally, lid 10 is circular in shape and has the lip 14 contained on its outer periphery. Lid 10 can be made of several materials, such as plastic. The plurality of compartments 16 are approximately in a equi-distance from one another and adjacent to lip 14. As can be seen, dividers 18 are aligned substantially juxtaposed from one another to create the outer limit of compartment 16. Plungers 20 are arranged in compartments 16 and are aligned in a equidistance and juxtaposed position from one another. As can be seen in FIG. 2, plungers 20 are in a cross-shaped configuration. Opening 22 is on the outer edge of lid 10 and is defined by perforations 28. In addition, steam hole 24 is aligned in a coaxial position with respect to lid 10.

Figure 3:
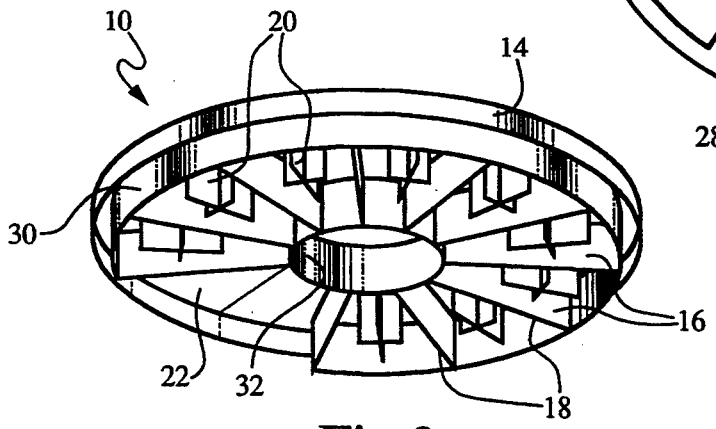
FIG. 3 is a perspective view of the bottom of the lid.

FIG. 3 shows a bottom perspective of lid 10. Lid 10 has the outer lip 14 at its outer edge. Aligned substantially parallel and coaxial with the lip is an external rim 30. In addition, a internal rim 32 is coaxial with external rim 30. As can be seen in FIG. 3, the formation of the compartment 16 can be seen. The plurality of dividers 18 are aligned in a juxtaposed position which are connecting inner rim 32 to outer 30 to create the compartments 16. After the compartments have been created, plungers 20 are affixed to the bottom of the lid 10 for later operation.

FIG. 4 shows an exploded view of lid 10. As can be seen, the method of manufacturing can be more readily understood. Internal rim 32 is in a substantially circular shape. The plurality of dividers 18 are positioned away from internal rim 32 and are substantially juxtaposed with one another. In addition, dividers 18 are in an equi-distance from one another. The combination dividers 18 and internal rim 32 can be connected to the bottom of lid 10 such that the internal rim 32 is coaxial with the lid 10. The dividers 18 are connected to the internal surface of the external rim 30 in order to create the plurality of compartments. Inserted within the compartments 16 are the plurality of plungers 20 which are X-shaped and are inserted into compartments 18 and connected to the bottom surface of lid 10. As can be seen, steam hole 24 is substantially coaxial with the internal rim 32 and external rim 30. In addition, lip 14 is coaxial with the external rim 30 and internal 32. As can be appreciated, the plurality of dividers 18, external rim 30 and internal rim 3 are aligned substantially perpendicular to the bottom surface of lid 10 in its preferred embodiment.

Referring now to FIG. 5, the bottom cover 34 can be seen. It should be understood that bottom cover 34 is connected to the bottom of lid 10 in order to seal additives (not shown) within the compartments. Bottom cover 34 can be made of several membrane-like materials, such as plastic, paper or foil. The additives (not shown) can one of many, for example the additives can comprise sugar, artificial sweetener, artificial cream flavoring and instant coffee. Bottom cover 34 has a plurality of perforations 36 formed therein which are mirror images of the configuration of the compartment (not shown). In addition, cover 34 has a bottom access 38 formed therein for permitting the access to the cup when the lid (not shown) is opened.

FIG. 6 shows an alternative embodiment of the present invention. Specifically, lid 40 is generally a lip 42 integrally connected to lid 40. Formed within lid 40 is a plurality of contours 46. Contours 46 are generally hemispherical in shape, but can be one of several different shapes as can be appreciated by one skilled in the art. Contours 46 have membranes 50 connected thereto for creating chambers 44. As can be appreciated, chambers 44 have selected additives 48 contained therein. As part of the invention, the chambers 44 can be positioned anywhere along lip 40.

In operation, user 26 asserts pressure against the external surface of lid 40 at its contour 46. By asserting the pressure on a selected contour 46, pressure is applied to the internal portion of chamber 44 thus causing additive 48 to assert pressure against membrane 50. By asserting such pressure against membrane 50 a rupture 52 is created thus causing the additive 50 to dispense within cup 12. The rupturing of membrane 50 can be more easily permitted by having perforations formed therein for controlling and reducing the amount of pressure necessary to rupture membrane 50.

In summary, the present invention discloses a lid having a plurality of compartments formed therein. As can be appreciated by one skilled in the art the compartments can be formed with either a plunger or without a plunger. In essence, the compartments have selected additives contained therein and can be easily inserted into a cup when a user selectively asserts pressure against a particular part of the lid to cause the compartment to have access to the cup.

Modifications of this invention will occur to those skilled in the art. Therefore, it is to understood that the invention is not limited to the particular embodiments disclosed, but that it is intended to cover all modifications which are within the spirit and scope of this invention as claimed.

What is claimed is:

1. An apparatus for dispensing a plurality of additives into a cup, comprising:

a lid having an external rim and an internal rim, said internal rim aligned co-axially with said external rim;

a plurality of dividers extending from said internal rim, said dividers being fused to said external rim to create a plurality of compartments for holding the additives;

a plurality of plungers positioned in said compartments; and a bottom cover connected to said compartments, said bottom cover being penetratable such that the additive is dispensed into the cup when pressure is applied to said lid forcing said plungers to puncture said bottom cover.

2. The apparatus as recited in claim 1, wherein said lid having a lip integrally connected thereto for securing said lid to the cup.

3. The apparatus as recited in claim 1, wherein said lid having perforations contained therein for selectively creating an opening.

4. The apparatus as recited in claim 1, wherein said internal rim is substantially circular in shape.

5. The apparatus as recited in claim 1, wherein said external rim is substantially circular in shape.

6. The apparatus as recited in claim 1, wherein said dividers are in a juxtaposed position with respect to each other.

7. The apparatus as recited in claim 1, wherein said compartments are perpendicular to said lid.

8. The apparatus as recited in claim 1, wherein said bottom cover having a series of perforations contained therein for permitting ease of penetration.

9. The apparatus as recited in claim 1, further comprising a steam hole formed in said lid.

10. The apparatus as recited in claim 1, wherein said plurality of additives comprises sugar, artificial sweetener, artificial cream, flavoring, and instant coffee.

11. An apparatus for permitting a user to dispense additives in a fluid contained in a cup, comprising:

a lid having a bottom surface and a top surface, said lid having a lip integrally connected thereto for securing said lid to the cup, said lid having perforations for permitting the user to selectively create an opening;

a circular-shaped external rim perpendicularly connected to said bottom surface of said lid;

a circular-shaped internal rim perpendicularly connected to said bottom surface of said lid, said internal rim aligned co-axially with said external rim;

a plurality of dividers extending from said internal rim and positioned juxtaposed to each other and perpendicular to said lid, said dividers being fused to said external rim to create a plurality of compartments for holding the additives;

a plurality of plungers positioned in said compartments, said plurality of plungers extending perpendicular from said lid; and a bottom cover sealably connected to said compartments, said bottom cover having a series of perforations, said perforations permit rupturing of said bottom cover to allow the additive to be dispensed from said compartments to the fluid in the cup when the user presses said top surface of said lid to force said plunger to abut against said bottom cover.

12. The apparatus as recited in claim 11, further comprising a steam hole formed in said lid for permitting any vapor of the fluid to escape.

13. The apparatus as recited in claim 11, wherein said plurality of additives comprises sugar, artificial sweetener, artificial cream, flavoring, and instant coffee.

14. The apparatus as recited in claim 11, wherein said lid is made of plastic.

* * * * *